US006609846B1

(12) United States Patent
Lai et al.

(10) Patent No.: US 6,609,846 B1
(45) Date of Patent: Aug. 26, 2003

(54) RETRACTABLE WRITING INSTRUMENT

(75) Inventors: Kui-Cheung Lai, Kowloon (HK); Shun Sang Poon, Kowloon (HK)

(73) Assignee: Longreen Marketing Ltd., Kowloon (HK)

( * ) Notice: Subject to any disclaimer, the term of this patent is extended or adjusted under 35 U.S.C. 154(b) by 0 days.

(21) Appl. No.: 10/247,041

(22) Filed: Sep. 17, 2002

(30) Foreign Application Priority Data

Apr. 19, 2002 (HK) ..... 02102962

(51) Int. Cl.[7] ..... B43K 24/02
(52) U.S. Cl. ..... 401/112
(58) Field of Search ..... 401/112, 111, 401/110, 109, 66

(56) References Cited

U.S. PATENT DOCUMENTS 2,803,219 A * 8/1957 Stoeberl ..... 401/112
2,896,577 A * 7/1959 Merryman et al. ..... 401/112
4,917,519 A * 4/1990 White et al. ..... 401/99

* cited by examiner

*Primary Examiner*—Gregory Huson
*Assistant Examiner*—Huyen Le
(74) *Attorney, Agent, or Firm*—Jiawei Huang; J.C. Patents

(57) ABSTRACT

A writing instrument with a retractable refill mechanism comprises: an replaceable refill having a front end as the pen tip, a pen barrel which has a front end opening and accommodates said refill, a slider positioned at the rear end of the refill and slidable in the cavity inside of said pen barrel, a connecting rod with one end pivotally connected to said slider, an inner gear mounted inside of the pen barrel and off-axially and pivotally connected with said connecting rod, and an outer gear mounted inside of the pen barrel and engageable with said inner gear. Therefore, by means of the connecting rod off-axially connected to the rotatable inner gear, the rotation of the inner gear is converted to a linear motion of the slider.

18 Claims, 1 Drawing Sheet

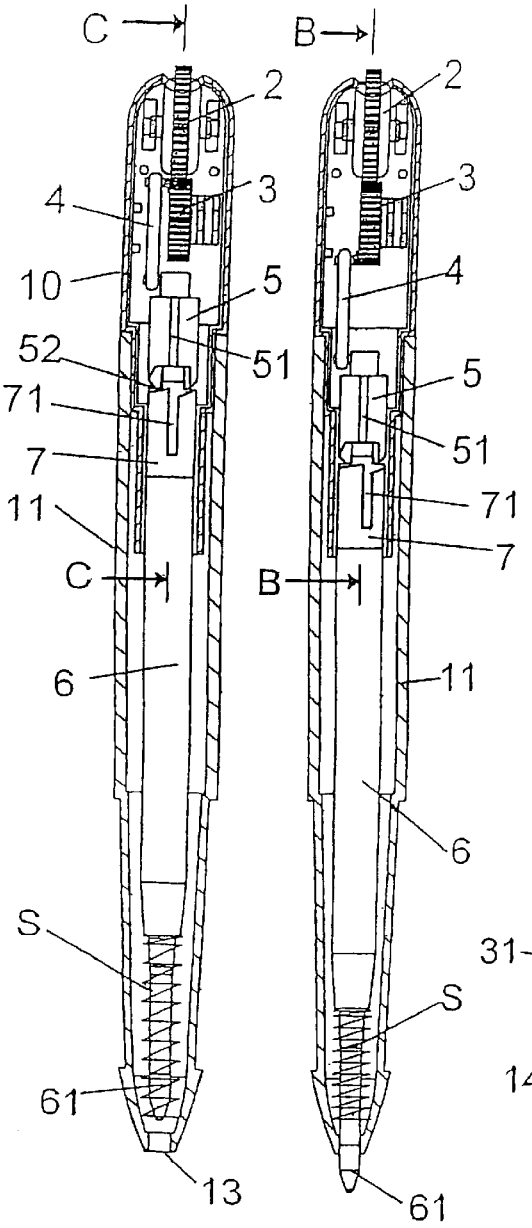
FIG. 2
FIG. 3
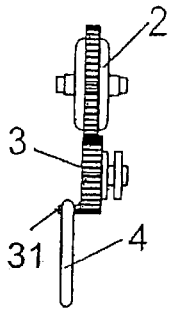
FIG. 4
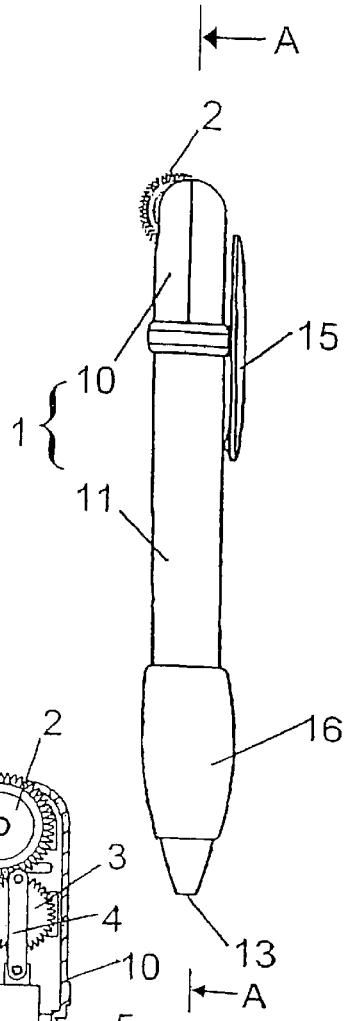
FIG. 1
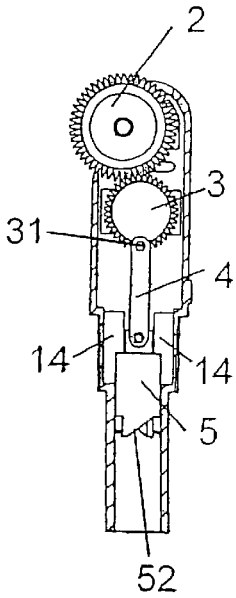
FIG. 5
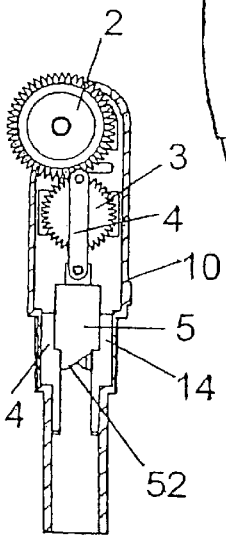
FIG. 6

RETRACTABLE WRITING INSTRUMENT

TECHNICAL FIELD

The present invention relates to a writing instrument, in particular to a ballpoint pen, whose refill with a pen tip can be projected from and retracted into the front end opening of the pen barrel by the operation of the actuating mechanism.

BACKGROUND ART

Conventionally, a plunger type ball-point pen, whose pen tip can be projected from and retracted into the front end opening of the pen barrel, is well known. The structure of the plunger type ballpoint pen is as follows: there is a freely-sliding expendable ballpoint pen refill in the pen barrel; the expendable ballpoint pen refill has a tendency of moving toward the upper part of the pen barrel under the force of a spiral spring; a wheel actuating mechanism for the plunger type refill is mounted at the rear end of the ballpoint pen refill; the actuating mechanism consists of a plunger projecting out of the upper opening of the pen barrel, several terraced oblique plane structures on the interior wall of the pen barrel and grooves formed between said structures, a wheel part provided at the front end of the plunger with a projection slidable along said grooves and a wheel with its projection biased connected to the projecting rib when engaged with said wheel part so that the wheel may rotate between said grooves or said terraces. The wheel rotates in a predetermined direction with the depression of the plunger and springs back due to the spiral spring. But with the deflection of the wheel, the tip of the expendable ballpoint pen refill is projected from and retracted into the front end opening of the pen barrel.

Another existing type of retractable pen is similar to the above type, whose pen tip is projected and retracted through the mutual press engagement of the upper and lower part of the pen barrel.

SUMMARY OF THE INVENTION

The object of the present invention is to provide a pen with a new structure for projecting and retracting pen tip.

In order to achieve the above object, the pen of the present invention converts the rotation of a gear to a linear motion of the slider along a pen barrel by means of a connecting rod off-axially connected to the rotatable gear.

The present invention provides a writing instrument with a retractable pen tip mechanism, characterized in that it comprises: an expendable refill having a front end as the pen tip, a pen barrel which has a front end opening and accommodates said refill, a slider positioned at the rear end of the refill and slidable in the cavity inside said pen barrel, a connecting rod with one end pivotally connected to said slider, an inner gear mounted inside the pen barrel and off-axially and pivotally connected with said connecting rod, and an outer gear mounted inside of the pen barrel and engaged with said inner gear.

DESCRIPTION OF DRAWINGS

FIG. 1 is an exterior plane view of the retractable pen of the present invention in its wholly retracted position;

FIG. 2 shows a view of the section A—A of FIG. 1, with the anti-skid pad omitted;

FIG. 3 is a sectional view similar to FIG. 2, but the pen is in its advanced writing position;

FIG. 4 is a sectional view similar to the FIG. 3, with the entire pen barrel and the refill omitted;

FIG. 5 is a sectional view of the upper part of the pen barrel along the line B—B in FIG. 3, with the lower pen barrel and refill omitted;

FIG. 6 is a sectional view of the upper part of the pen barrel along the line C—C in FIG. 2.

DESCRIPTION OF EMBODIMENTS

The embodiments of the present invention will be described with reference to the drawings. The same components and the same parts are designated by the same numerals.

FIG. 1 shows a retractable pen of the present invention in its retracted non-writable position. In FIG. 1, the pen has a hollow pen barrel 1 comprising an upper part 10 that uses the structure of two halves of houses clamping together and a lower part 11 that has a front end opening 13. The upper part 10 is provided with an outer gear 2 that is partially exposed out of the pen barrel through a groove. The pen barrel 1 is equipped with a pen-clip component 15 for fixing the pen barrel to, e.g., a shirt pocket. In addition, a conventional anti-skid sheath 16 made of ebonite or pliable rubber or other suitable material is provided on the outer surface of the lower part 11 of the pen barrel 1.

With reference to FIGS. 2–6, a conventional expendable refill 6 is installed or housed inside the retractable pen. The front end with a reduced section of the refill 6 is a pen tip 61 for writing, and is able to be exposed out of the front end opening 13, and is coupled to a spiral spring S. Consequently, the refill 6 has a tendency to move toward the upper end of the pen barrel due to the spiral spring. In addition, the rear end of the refill 6 is connected to or integrally incorporated with a wheel 7. The wheel 7 has a rotating groove 71 with terraced oblique ends. The groove 71 may engage with the guiding mechanism 14 (FIG. 6) of a projecting rib in the pen barrel. Moreover, the wheel 7 is provided with a slider 5, which engages with the projecting rib on the interior wall of the pen barrel by grooves 51 on the two sides of the slider 5 so that the slider 5 is slidable along the cavity inside the pen barrel. The lower end of said slider 5 is provided with a rotating actuating structure having a lower oblique face end 52 for rotating the wheel 7. When the rotating groove 71 of the wheel 7 is still fitted to the guiding mechanism as shown in the FIG. 2, the wheel 7 does not rotate. But when the rotating groove 71 of the wheel 7 is not fitted to the guiding mechanism as shown in FIG. 3, the wheel 7 slightly rotates because of the lower oblique face end 52 of the slider 5. For example, the rotating groove 71 shown in the FIG. 3 has a little bit rightward displacement. Whereas, when the slider 5 slides upward, as the spring S has a tendency to move the pen barrel upwards, the rotating groove of the wheel 7 returns to fit to the guiding mechanism because of the inclined face at the lower end of the guiding mechanism 14.

The upper end of the slider 5 is connected to a connecting rod 4 through a pivot shaft; the other end of the connecting rod is pivotally connected to an inner gear 3 through another pivot 31, wherein pivot 31 is biased away from the axle center of the inner gear 3. Besides, the inner gear 3 is engaged with the outer gear 2 provided at the upper end of the pen barrel. Thus, when the user rotates the outer gear 2 clockwise or counterclockwise, the inner gear 3 rotates accordingly.

As the connecting rod 4 is off-axially and pivotally connected to the inner gear 3 and the slider 5 may move along the pen barrel in a linear motion only, the connecting rod 4 converts the rotation of the inner gear 3 to the linear motion of the slider 5. Thus, when the slider 5 moves toward the lower end of the pen barrel against the spring S, the refill is projected as shown in FIG. 2; when the slider moves toward the upper end of the pen barrel, the refill 6 is retracted under the elastic resilience of the spring S until pen tip 61 is fully retracted to its wholly retracted position as shown in FIG. 2.

For the quick retraction and projection of the pen tip 61, the diameter of the outer gear 2 is bigger than that of the inner gear 3 so that when the outer gear 2 rotates less than 180 degrees, the inner gear 3 is already able to move the slider 5 from its position shown in the FIG. 3 to the position shown in the FIG. 2, i.e., the refill is converted from the projected writing position to the retracted position, and vice versa.

As shown in FIGS. 2 and 3, the distance between the wholly projected and retracted positions of the pen tip is two times the off-axial distance between the pivot 31 and the inner gear 3.

The rotating center of the inner gear 3, the connecting rod 4, the slider 5 and the refill 6 are all on the vertical axis of the pen barrel 1 in the plane shown in the FIGS. 5–6, while the center of the outer gear 2 is biased away from the vertical axis of the pen barrel so that the outer gear 2 is further exposed outward, which is convenient for the user to rotate.

It is clearly shown especially in the FIG. 4 that in the major components of the present invention, the inner gear 3 has a structure similar to a double-layer teeth structure, i.e., there is a narrowed axle in the center. Thus, the inner gear 3 is fixed by clamping the narrowed axle.

The present invention has been described with reference to the embodiments. However, it should be understood that the present invention is not limited to the details of the specified structures and that variations and modifications may be made without departing from the scope of protection of the claims of the present invention.

For instance, the outer gear may be installed on the side of the pen barrel, or may have a double-gear actuating structure, or may have a unidirectional rotation mechanism.

What is claimed is:

1. A writing instrument with retractable pen tip, comprising:

a refill with a pen tip at its front end;

a pen barrel having a cavity for accommodating said refill and having a front end opening;

a slider slidable along the cavity inside the pen barrel, which is provided at a rear end of the refill;

a connecting rod with one end pivotally connected to said slider;

an inner gear mounted inside of the pen barrel and off-axially and pivotally connected with said connecting rod, and an outer gear mounted inside of the pen barrel and engaged with said inner gear.

2. A writing instrument as claimed in claim 1, wherein said outer gear is located at an upper end of the pen barrel.

3. A writing instrument as claimed in claim 2, wherein said slider has grooves and said pen barrel has projection inside thereof.

4. A writing instrument as claimed in claim 3, wherein said pen barrel comprises an upper part and a lower part.

5. A writing instrument as claimed in claim 4, wherein said upper part of the pen barrel comprises two halves of houses.

6. A writing instrument as claimed in claim 5, wherein said outer gear may rotate both clockwise and counterclockwise.

7. A writing instrument as claimed in claim 5, wherein said pen barrel is provided with a pen clip component.

8. A writing instrument as claimed in claim 5, wherein said pen barrel is provided with an anti-skid sheath.

9. A writing instrument as claimed in claim 5, wherein said refill is provided with a spring (S).

10. A writing instrument as claimed in claim 4, wherein said outer gear may rotate both clockwise and counterclockwise.

11. A writing instrument as claimed in claim 4, wherein said pen barrel is provided with a pen clip component.

12. A writing instrument as claimed in claim 4, wherein said pen barrel is provided with an anti-skid sheath.

13. A writing instrument as claimed in claim 4, wherein said refill is provided with a spring (S).

14. A writing instrument as claimed in claim 1, wherein said outer gear may rotate both clockwise and counterclockwise.

15. A writing instrument as claimed in claim 1, wherein said pen barrel is provided with a pen clip component.

16. A writing instrument as claimed in claim 1, wherein said pen barrel is provided with an anti-skid sheath.

17. A writing instrument as claimed in claim 1, wherein said refill is provided with a spring (S).

18. A writing instrument as claimed in claim 1, wherein said refill is provided at its rear end with a wheel that has rotating grooves with terraced inclined surface end, and wherein the slider has a lower inclined face end.

* * * * *